US006133854A

United States Patent [19]

Yee et al.

[11] Patent Number: 6,133,854

[45] Date of Patent: Oct. 17, 2000

[54] SATELLITE SUPPORTED TRAFFIC SIGNAL CONTROLLER

[75] Inventors: David Moon Yee, Scottsdale; Robert Henry Bickley, Paradise Valley; Philip John Zucarelli, Glendale; Theodore Woolley Keller; Jeff Scott Osman, both of Scottsdale, all of Ariz.

[73] Assignee: Motorola, Inc., Schaumburg, Ill.

[21] Appl. No.: 09/115,351

[22] Filed: Jul. 14, 1998

[51] Int. Cl.[7] ..... G08G 1/095

[52] U.S. Cl. ..... 340/907; 340/909; 340/910; 340/917; 455/12.1; 455/427; 455/430

[58] Field of Search ..... 340/907, 909, 340/911, 915, 916, 906, 994, 931; 455/12.1, 427, 428, 430, 456, 13.1

[56] References Cited

U.S. PATENT DOCUMENTS

| | | | |
|---|---|---|---|
| 4,907,160 | 3/1990 | Duncan et al. | 364/436 |
| 5,014,052 | 5/1991 | Obeck | 340/906 |
| 5,119,504 | 6/1992 | Durboraw, III | 455/54.1 |
| 5,172,113 | 12/1992 | Hamer | 340/907 |
| 5,333,178 | 7/1994 | Norell | 379/59 |
| 5,345,232 | 9/1994 | Robertson | 340/906 |
| 5,539,398 | 7/1996 | Hall et al. | 340/907 |
| 5,729,214 | 3/1998 | Moore | 340/905 |
| 5,745,865 | 4/1998 | Rostoker et al. | 701/117 |
| 5,926,113 | 7/1999 | Jones et al. | 340/906 |
| 5,949,766 | 9/1999 | Ibanez-Meier et al. | 370/316 |

*Primary Examiner*—Jeffery A. Hofsass
*Assistant Examiner*—Toan Pham
*Attorney, Agent, or Firm*—Bradley J. Botsch

[57] ABSTRACT

A local traffic signal controller (3) is interfaced to a satellite subscriber unit (10) to provide for centralized control of the traffic signals (1) controlled by the local controller (3). A central controller (7) provides central control and can download program control information to local controller (3). Dial-up access to local controller (3) is provided to central controller (7) with the subscriber unit (10). The resultant communication path may be utilized to provide for accessing information from the local traffic signal controller (3). Such information may include indications of lamp failures, traffic pattern information and other status or traffic related information.

29 Claims, 3 Drawing Sheets

100

SATELLITE SUPPORTED TRAFFIC SIGNAL CONTROLLER

FIELD OF THE INVENTION

This invention pertains to a system for controlling vehicular traffic control signals.

BACKGROUND OF THE INVENTION

Vehicular traffic at intersecting streets is typically controlled by traffic control lights. These lights include the well-known red, yellow and green lights as well as lights to indicate protected turns. Typically the lights are operated in accordance with predetermined timing sequences by a controller. Various controllers have been developed and used to control traffic lights. The controllers in use include electromechanical controllers of various types, electronic controllers, and controllers which include microprocessors to generate various timing and control signals. One disadvantage with such traffic signal controllers is that to change the operation of the traffic lights at an intersection, an individual would typically be required to travel to the intersection and enter permanent or temporary changes into the controller. Changes in the operation of the controller may be desirable to modify the timing of the lights or the sequence of operation. Such changes may be necessary as a result of changed traffic patterns, special events, construction or for numerous other reasons.

There are traffic control systems in which centralized computers control local controllers. A significant disadvantage to centralized control systems is that each local traffic signal controller is physically located near the traffic signals to be controlled and the centralized control arrangement must communicate with the traffic signal controllers either over a hard wired network or by means of specialized radio equipment. The expense of providing centralized control of traffic control signals over a large number of intersections is often prohibitive.

The problem of traffic management under varying conditions is a significant problem and one for which an inexpensive solution is desired.

BRIEF DESCRIPTION OF THE DRAWINGS

The invention will be better understood from a reading of the following detailed description in conjunction with the drawings in which like reference numerals designate like elements and in which.

DETAILED DESCRIPTION

The present invention advantageously employs satellite cellular system subscriber units. One such unit is described in U.S. Pat. No. 5,119,504 to Issac N. Durboraw III, which is assigned to the assignee of the present invention. The disclosure of the Durboraw III patent is incorporated herein by reference. The subscriber unit of the Durboraw III patent is particularly useful with a low-earth orbit satellite communication system such as the Iridiumrm™ satellite communication system manufactured by Motorola, Inc.

Although that subscriber unit is a position aided unit which utilizes a Global Positioning System (GPS) and voice/data communication device for use with a satellite communication system, it will be understood by those skilled in the art that other subscriber units for use with a satellite communication system may be used in a system in accordance with the invention.

Figure 1:
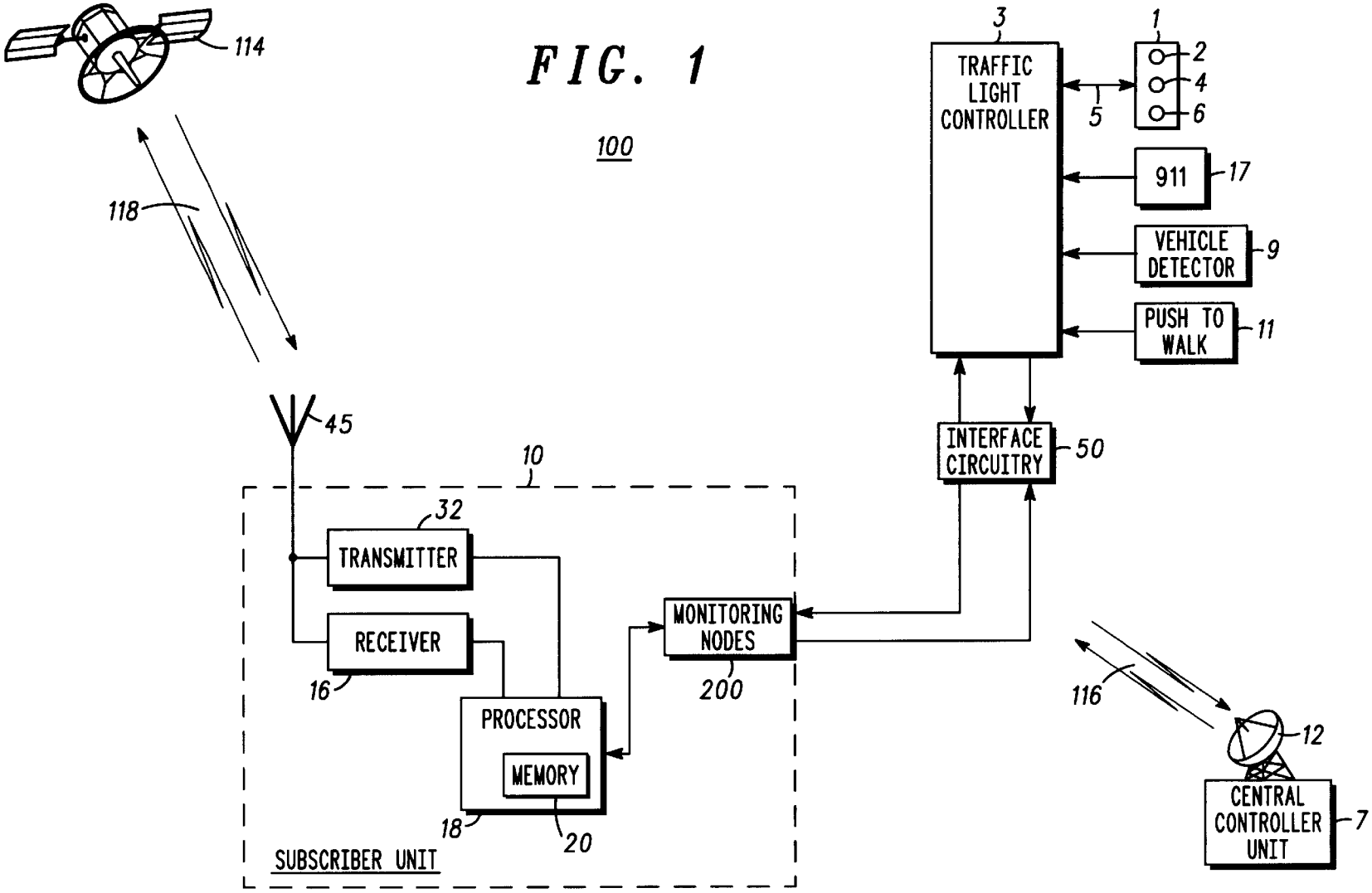
FIG. 1 is a block diagram of a traffic control system in accordance with the principles of the invention.

Turning now to FIG. 1, a traffic control system 100 in accordance with the invention is shown. In that arrangement, a traffic signal 1 is oriented above an intersection. Although only one traffic signal device 1 is shown, as is commonly known, there may be one or more such devices at an intersection for each direction of traffic. In addition, the traffic signal 1 as shown has only three signal lights, i.e., a red light 2, a yellow light 4 and a green light 6, but as is well known, the traffic signal 1 may include other lights for protected turns. The traffic signal 1 may therefore be of any known construction and arrangement.

The traffic signal 1 is connected to a traffic light controller 3 via a bus 5. The traffic light controller 3 may be of any conventional design and may, for example, utilize a micro controller to control the timing sequence of operation of the signal lights 2, 4 and 6. The controller 3 may for example, be a controller such as the local controller shown and described in U.S. Pat. No. 3,816,796, the subject matter of which is incorporated by reference herein. In the system shown therein, a central computer is used to provide centralized monitoring and control of a number of local traffic controllers. One disadvantage of this system as well as other systems in which a central control arrangement is provided is that expensive hard-wired connections such as voice grade telephone lines must be run to each local controller. Alternatively expensive radio transceivers must be provided at each local controller and a specialized radio communication system must be established. This has the additional inconvenience of requiring Federal Communications Commission licensing for the transmitters. Still further, these prior systems typically require that the entirety of existing traffic signal controllers be replaced in order to be compatible with the control arrangement.

The specific details of traffic light local controller 3 are of little significance to the present invention. Controller 3 can be an older electro-mechanical controller, or it can be a microprocessor controlled controller or it can be a local controller designed to operate with a central controller 7 as shown in FIG. 1. Central controller 7 has the functionality of the master controller described in the above-referenced U.S. Pat. No. 3,816,796. Controller 3 may have all known functionality of prior system controllers, whether designed as local controllers in a centralized system such as described in U.S. Pat. No. 3,816,796 or whether designed as a stand alone controller which includes microprocessor control or electronic control or electromechanical control. For example, controller 3 may operate with vehicle detector 9. Vehicle detectors are well known in the art. Such detectors can include induction loop devices or magnetic stripes used to sense the presence of vehicles. When one or more vehicles are detected, controller 3 operating in a different predefined mode of operation may change operation of the traffic lights. For example, with a vehicle detector 9 positioned in a left turn lane, controller 3 may cause a protected turn light to operate as part of the timed sequence of operation of traffic signal 1, or it may provide for an extended green light in the direction of traffic in which the turning vehicle is headed before the turn.

Controller 3 may also respond to other traffic control devices, such as a "push to walk" button or buttons 11.

Controller 3 can also provide timing control of walk/ don't walk lights. Controller 3 can also respond to conventional emergency vehicle priority control arrangements such as the use of strobe lights on emergency vehicles to control the traffic light 1. In addition, controller 3 can include circuitry to detect failure of a signal light 2, 4 and 6.

Prior art traffic management systems typically rely heavily on a local human presence to modify traffic light behavior, detect traffic related problems, detect problems with the traffic lights and provide information for statistical analysis such as the number of vehicles per unit of time. However, controller 7, in accordance with the principles of the invention, is not coupled to a plurality of local controllers via conventional prior art terrestrial based telephone or hard wired connections as taught in the prior art. Central controller 7 can access any of a plurality of local controllers 3 in a system in accordance with the invention by "dialing" or accessing the local controller via the telephone number of the local controller's satellite subscriber unit 10 and sending information to local controller 3 via conventional satellite communication facilities which are shown schematically. This satellite based communication link is represented in FIG. 1 as a satellite antenna 12 and satellite 114 along with the satellite communication links 116, 118. It will be understood by those skilled in the art that there is known infrastructure in a satellite communication system and it is not intended by the schematic illustration of a satellite communication system by means of the antennas 12 and 45, satellite 114, and communication links 116, 118 that the invention is to be in any way limited. In accordance with the invention, a satellite subscriber unit 10 is interfaced to the traffic signal controller 3 by means of interface circuit 50. The satellite subscriber unit 10 may be a conventional, commercially available Iridium™ subscriber unit available from Motorola, Inc. and adapted for use with the Iridium™ system or may be a subscriber unit useable with other satellite based personal communication systems. One version of subscriber unit 10 is described in detail in U.S. Pat. No. 5,119,504, the disclosure of which is specifically incorporated herein by reference. A subscriber unit 10 includes a satellite antenna 45. The antenna 45 may be of conventional design that is commercially available. Antenna 45 is coupled to transmitter 32 and to receiver 16. Both transmitter 32 and receiver 16 are of known design. A microprocessor 18 having a memory 20 is used to control the operation of the subscriber unit 10. Microprocessor 18 is programmed to retrieve information from controller 3 via interface circuitry 50. Microprocessor 18 is further programmed to transmit information from the controller 3 via transmitter 32 to central controller 7 via satellite 114. In addition, microprocessor 18 is responsive to data and command information received from central controller 7 via satellite 114 to control operation of the controller 3. Although not specifically described in the '504 patent, the subscriber unit includes a digital signal port 101. The digital port 101 is used to provide signal information that is received by subscriber unit 10 to the controller 3. Subscriber unit 10 shown in the embodiment of FIG. 1 includes a digital output that is coupled to interface 50. Interface 50 converts the signal outputs from the subscriber unit 10 to signals appropriate to the particular controller 3. For example, if controller 3 is a microprocessor-based controller, interface 50 can merely provide signal conversion and isolation. If controller 3 is implemented with electromechanical devices, interface 50 provides more extensive signal conversion and isolation. In addition, interface unit 50 provides for signal conversion and isolation for signals received from controller 3 for subscriber unit 10. As will be appreciated by those skilled in the art, the design of interface units 50 between a device such as subscriber unit 10 and a traffic signal controller 3 is straightforward. This is an advantage to the present invention in that any traffic light controller may be coupled into a central controlled traffic system by merely selecting an appropriate interface 50 and placing a conventional commercially available subscriber unit 10 at the local controller. Each subscriber unit 10 has a unique telephone number associated with it and central controller 7 can selectively address a traffic controller by its telephone number. Thus, central controller 7 can selectively address a local controller 3 and transmit a new program for operating the associated signal devices such as signal 1 or a program update to controller 3 via conventional telephone based satellite systems and achieve many of the advantages of prior centralized traffic control systems without the costs associated of having a hard wired system or having a telephone line and modem connected to the controller.

With a subscriber unit 10 such as the one shown in the FIG. 1, traffic light controller 3 can provide response information back to central controller unit 7. The response information includes an acknowledgment that information sent by central controller unit 7 has been received at subscriber unit 10. In addition, subscriber unit 10 transmits information initiated at traffic controller 3, such as a 911 call initiated by having a 911 call button 17 disposed in the vicinity of the traffic controller 3 and having it coupled to controller 3.

In addition, the use of a vehicle detector 9 with traffic controller 3 permits controller 3 to also be used to collect information regarding traffic volume at the intersection where the controller 3 is located. This traffic information is transmitted to central controller 7 via satellite links 116, 117. Central controller 7 can respond to certain traffic conditions by transmitting changed program information to local controller 3 to change the operation of local controller 3 to reflect a necessary or desired change in operation of traffic light 1. Also, local controller 3 may include circuitry that detects failure of one of the traffic lights 2, 4 or 6 and sends a message via the subscriber unit 10 to central controller 7 to automatically request maintenance service.

Still further in accordance with the principles of the invention, by providing a satellite subscriber unit 10 at traffic signal controller 3, an emergency vehicle may direct control of the traffic signal by using a cellular telephone to dial the telephone numbers of traffic controllers along its expected route to control operation thereof.

In operation, traffic light controller 3 controls the timing and sequence of the traffic light based on a program contained in controller 3. With the connection to satellite subscriber unit 10, a central controller 7 can reprogram the controller 3 by transmitting programming information via the satellite infrastructure represented by satellite 114 to a subscriber unit 10 co-located with a controller 3. The subscriber unit 10 returns information to central controller 7 to indicate traffic signal light bulb health, traffic statistics, 911-button status and acknowledgment of new programming information.

Figure 2:
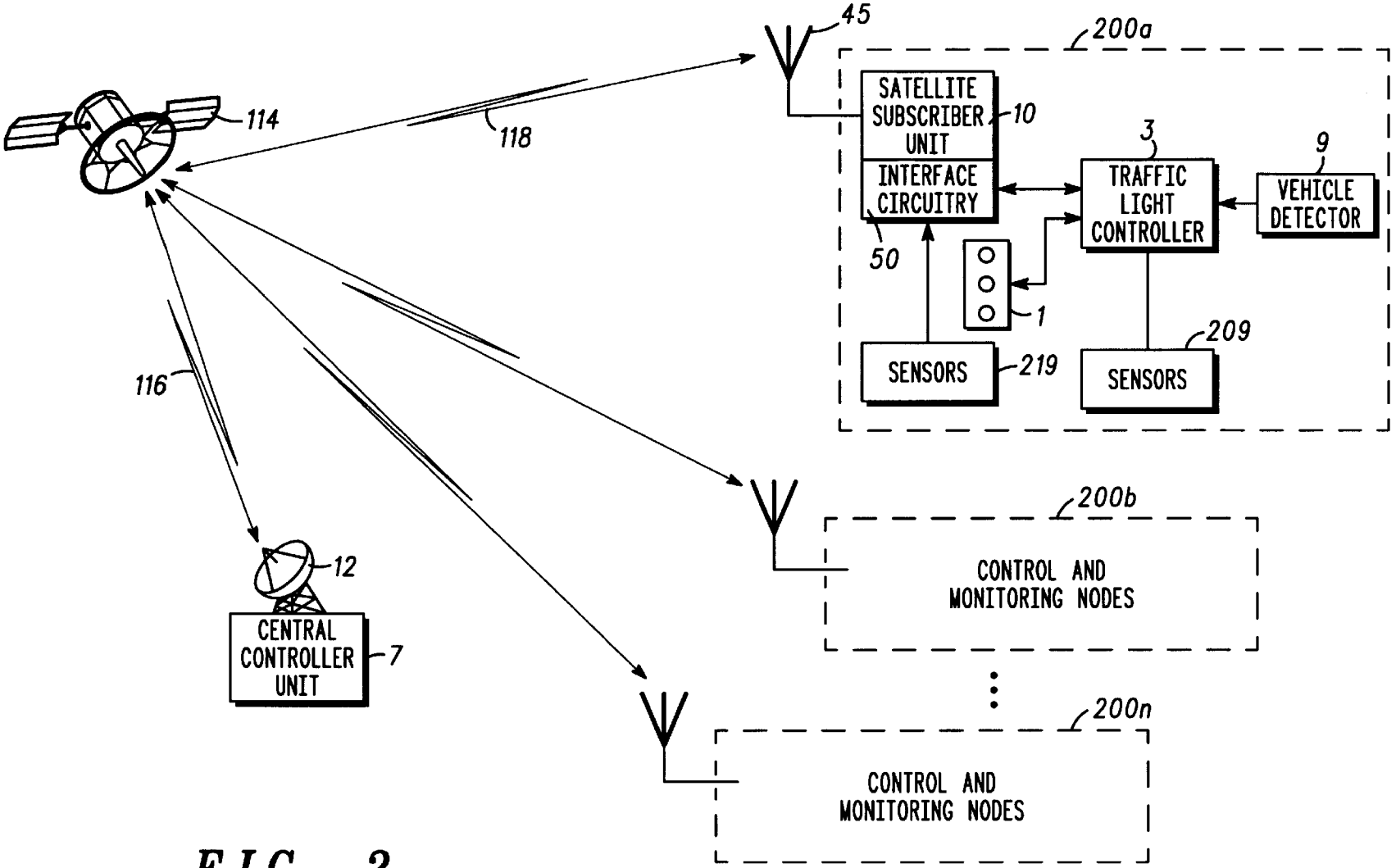
FIG. 2 is a block diagram of a wide area traffic control system in accordance with the principles of the invention.

Turning now to FIG. 2 a wide area vehicular monitoring and reporting system is shown. In the wide area arrangement, a plurality of traffic control and monitoring nodes 200*a* through 200*n* are used. Each of the nodes 200*a* through 200*n* includes a traffic controller 3 coupled to traffic control devices such as the traffic signals 1 of FIG. 1 and to various sensors such as vehicle detectors 9 or other sensors. The various sensors that may be coupled to the traffic controller 3 are indicated as sensors 209. The traffic controller 3 is coupled to an interface 50 that in turn is coupled to a satellite subscriber unit 10. In addition, various other sensors 219 may be coupled to interface 50. Still further, interface 50 can include a processor unit (not shown) which is used to compile the various data received from the sensors. The sensors. 209 may be directly connected to traffic controller 3 or may be coupled to controller 3 via a line of sight radio frequency link or a hard-wired link or any other link. Similarly, sensors 219 may be directly connected to the interface 50 or may be linked thereto by means of a line of sight radio link or other known link. The satellite subscriber unit 10 communicates to a central controller 7 via antenna 45, satellite 114 and associated links 118 and 116. The use of a central controller 7 which is linked to traffic and other sensors allows for effective management of major transportation centers under such circumstances as rush hour loading, weather related hazards and traffic flow perturbations such as those caused by accidents. The system may be used to augment existing traffic control networks.

Figure 3:
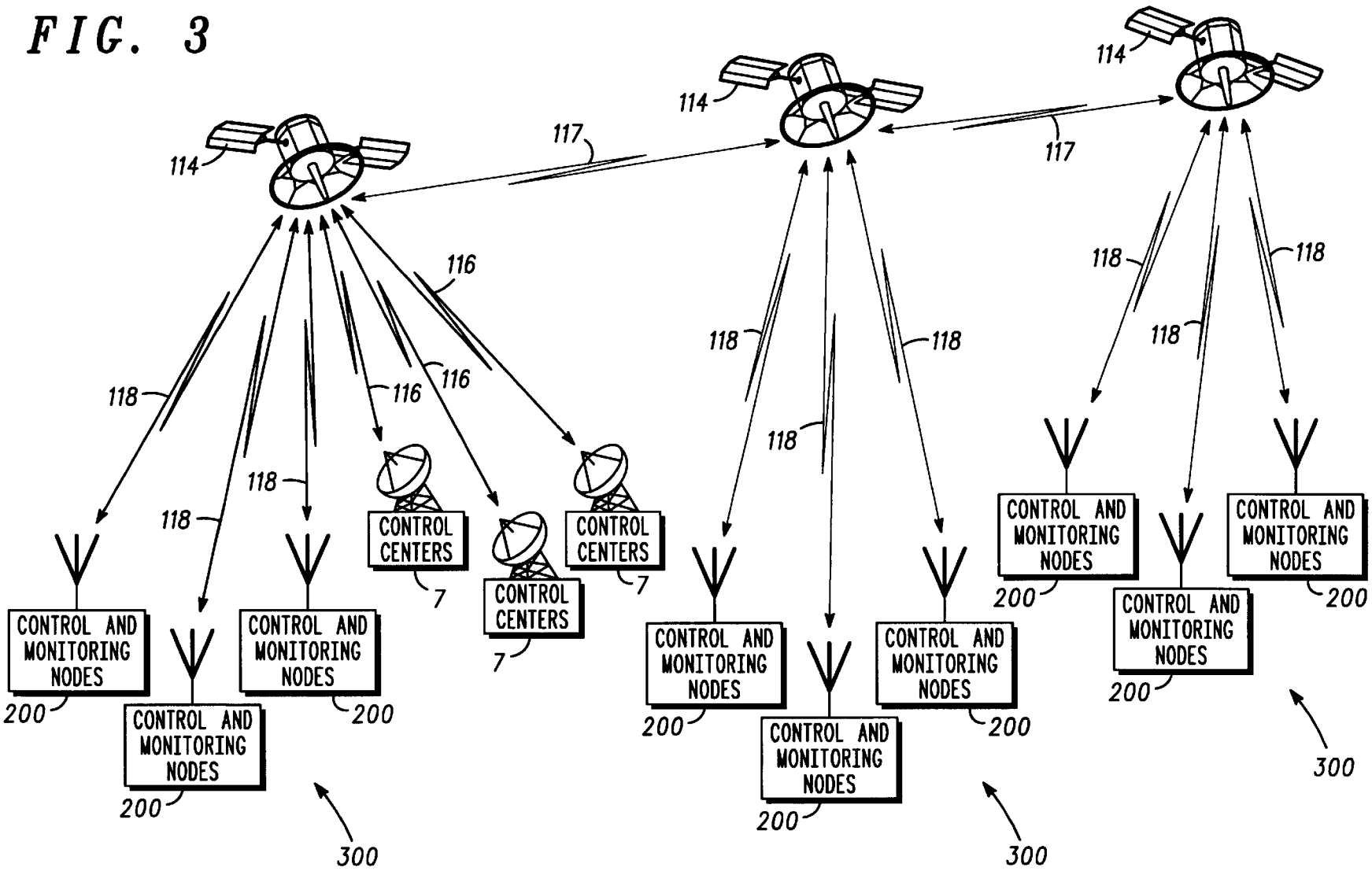
FIG. 3 is a block diagram of a wide area traffic control system in accordance with the principles of the invention.

Turning now to FIG. 3, a wide area vehicular monitoring and reporting system featuring multiple central control stations 7 and operable with one or more clusters 300 of traffic control and monitoring nodes 200 is shown. In this arrangement, one or more central control stations 7 communicate with a plurality of traffic control and monitoring nodes 200 via satellite links. Each cluster 300 of traffic control and monitoring nodes 200 may be located in a separate geographic area from the other clusters 300 and/or from the central control stations 7. Each cluster 300 may communicate with a different satellite 114 via links 118 in which case communication links 117 between satellites 114 may be used. Alternatively, one or more of the clusters 300 may communicate with the same satellite 114. Each of the central control stations 7 may be located in separate geographic areas, or one or more may be located in the same geographic area. Each central control station 7 has access to one of the satellites 114 via links 116. The central control stations 7 may communicate with each other via one of satellites 114. In a typical application of the system of FIG. 3, each central control station 7 operates with one or more predetermined clusters 300. Although all the central control stations 7 are shown as communicating with a single satellite 114, it will be understood by those skilled in the art that one or more of the central control stations 7 may be associated geographically with one of the clusters 300 and in that instance, the central control station 7 will be directly linked to the same satellite 114 that the associated cluster communicates. The central control stations are configured and operational such that in the event of failure of one of the central control stations 7, one or more of the remaining central control stations may communicate with and control the operation of the cluster 300 associated with the failed central control station 7. This arrangement of multiple, redundant control centers 7 allows each control center 7 to share information with any other control center 7 or all of the other control centers 7. Each control center 7 has the capability via satellite linking to take over the control of any other control center 7 in order to direct and control the vehicular monitoring and reporting system on a geographic regional basis. This may be particularly desirable in the event of a natural disaster or other emergency that impairs the operation of one or more control centers 7. The data path provided by satellites 114 and associated links 116, 117 and 118 between each control center 7 and the traffic control and monitoring nodes 200 permits each control center 7 to coordinate emergency response assets between respective geographic regions, even when all landline communication systems are unavailable or are damaged.

The system of FIG. 3 provides for dramatically improved immunity to extreme events such as wide spread civil disturbance, major fire, flood, earthquake or other natural or manmade disasters. Currently available systems that rely upon either wired or wireless land based communication systems would not function or would not function effectively under such disaster scenarios. The system in accordance with the invention permits data gathering or feedback from traffic control and monitoring nodes 200 and the operation of the system by one or more control centers 7 to reroute traffic to available roads and/or to indicate blocked routes. One or more of the control centers 7 could be utilized to control the operation of the entire traffic system if that is necessary or desirable. Each control center 7 in one embodiment of the invention interrogates traffic control and monitoring nodes 200 of its associated cluster 300. Each traffic control and monitoring node has associated therewith a telephone number associated with the subscriber unit coupled thereto. The associated control center 7 conducts the interrogation by dialing up the traffic control and monitoring node 200. In the event that a control center 7 takes over control and monitoring for another control center 7, the control center 7 taking over will interrogate the monitoring nodes 200 of the cluster 300 associated with the second control center 7. In addition, the control centers 7 may each maintain a status memory containing the status and telephone numbers of all nodes 200 in the system in the event that it may have to unexpectedly assume control of the entire system. In another embodiment of the invention, the traffic control and monitoring nodes 200 may respond to a broadcast command to a group call to return the call on a prearranged schedule thereby eliminating the need for the control centers 7 to individually call the nodes 200 for routine system reporting. A further significant advantage of the system in accordance with the invention is that by utilizing satellite linking, the control centers 7 may be remote from the traffic control and monitoring nodes 200. In fact, the control centers 7 may be located great distances from the control and monitoring nodes 200. Accordingly, a traffic control system in accordance with the invention may utilize a control center 7 located outside the region or state or country or continent where the control and monitoring nodes 200 are located. With such an arrangement the ability to provide disaster recovery capability for a traffic control infrastructure is significantly improved.

As will be appreciated by those skilled in the art, the invention has been shown and described in terms of one illustrative embodiment and that various changes and modifications may be made without departing from the spirit or scope of the invention. It is intended that the invention not be limited to the embodiment shown but that it be limited in scope only by the claims as appended hereto.

What is claimed is:

1. A traffic control system, comprising:

at least one traffic signal;

a traffic signal controller coupled to said traffic signal for controlling operation thereof, said traffic signal controller being responsive to first information to control said operation;

a satellite subscriber unit located within said traffic signal controller to provide said first information to said traffic signal controller, said satellite subscriber unit receiving said first information via an earth orbiting communication satellite; and wherein said satellite subscriber unit receives second information signals from said traffic signal controller for transmission via said earth orbiting communication satellite.

2. A traffic control system in accordance with claim 1, comprising:

an interface circuit disposed between said satellite subscriber unit and said traffic signal controller.

3. A traffic control system in accordance with claim 1, comprising:

sensors for sensing predetermined conditions, said sensors coupled to said traffic signal controller.

4. A traffic control system in accordance with claim 3, wherein:

said sensors includes at least one vehicle detector for detecting the presence of vehicles.

5. A traffic control system in accordance with claim 1, wherein:

said traffic signal controller comprises a program controlled microprocessor to control operation of said at least one traffic signal.

6. A traffic control system in accordance with claim 1, wherein:

said traffic signal controller comprises an electromechanical controller.

7. A traffic control system in accordance with claim 1, comprising:

an interface circuit disposed between said satellite subscriber unit and said controller to interface said first information signals to said traffic signal controller from said traffic signal controller and to interface said second information signals from said traffic signal controller to said satellite subscriber unit.

8. A traffic control system in accordance with claim 1, wherein:

said satellite subscriber unit has associate therewith a telephone number and is accessible via a satellite communication system by utilizing said telephone number.

9. The traffic control system in accordance with claim 1 wherein said earth orbiting communication satellite is a low earth orbiting satellite.

10. A method for operating a traffic control system, comprising:

utilizing a traffic signal controller for controlling the operation of one or more traffic signals in accordance with a predetermined program;

providing control information to said traffic signal controller from a central traffic controller wherein said control information is received by a satellite subscriber unit located within said traffic signal controller over a low earth orbiting (LEO) satellite system; and providing response information to said central traffic controller from said traffic signal controller wherein said response information is transmitted by said satellite subscriber unit to said central traffic controller over said LEO satellite system.

11. A method in accordance with claim 10, comprising:

providing second information from said central traffic controller to said traffic signal controller via said satellite subscriber unit.

12. A method in accordance with claim 11, comprising:

utilizing said second information to modify said predetermined program.

13. A method in accordance with claim 12, comprising:

monitoring a plurality of sensors;

providing information obtained from said sensors to said satellite subscriber unit; and transmitting said information via a satellite connection to a central traffic controller.

14. A method for controlling traffic control apparatus from a central traffic controller, comprising:

monitoring the operation of a plurality of traffic control apparatus at a central traffic controller wherein information regarding the operation of said plurality of traffic control apparatus is transmitted by satellite subscriber units located within one or more of said traffic control apparatus to said central traffic controller; and altering the operation of a selected one of said plurality of traffic control apparatus by communicating information from said central traffic controller to said selected one traffic control apparatus by transmission of said information via a satellite communication link from said central traffic controller to said satellite subscriber unit located within said selected one traffic control apparatus.

15. The method in accordance with claim 14 wherein said satellite communication link is a low earth orbiting satellite communication link.

16. A method of operating a traffic control apparatus, comprising the steps of:

controlling the operation of said traffic control apparatus by a traffic controller located proximate said traffic control apparatus;

operating a satellite subscriber unit to transmit first information from said traffic controller to a central traffic controller via a satellite system, wherein said satellite subscriber unit is located within said traffic controller;

receiving second information from said central traffic controller to said traffic controller via said satellite subscriber unit; and altering the operation of said traffic control apparatus in accordance with said second information.

17. A traffic control system, comprising:

at least one central control unit;

a communication link between said one central control unit and an earth orbiting communication satellite; and a plurality of local controllers each comprising:

at least one traffic signal;

a traffic signal controller coupled to said traffic signal for controlling operation thereof, said traffic signal controller being responsive to first information to control said operation;

a satellite subscriber unit coupled to said traffic signal controller to provide said first information to said traffic signal controller, said satellite subscriber unit receiving said first information via said earth orbiting communication satellite; and wherein each local controller of said plurality of local controllers receives second information signals from its respective said traffic signal controller for transmission to said at least one central control unit via said earth orbiting communication satellite.

18. A traffic control system in accordance with claim 16, comprising:

at least a second central control unit; and a second communication link between said second central control unit and said earth orbiting satellite;

said second central control unit being operable to communicate with said satellite subscriber unit.

19. A traffic control system in accordance with claim 17, wherein:

said first information is provided to said satellite subscriber unit from said at least one central control unit under first predetermined conditions and from said second central control unit under second predetermined conditions.

20. A traffic control system in accordance with claim 18, wherein:

said one central control unit is geographically remote from said plurality of local controllers.

21. A traffic control system in accordance with claim 17, comprising:

a second plurality of local controllers, each comprising: at least one traffic signal;

a traffic signal controller coupled to said traffic signal for controlling operation thereof, said traffic signal controller being responsive to first information to control operation of said traffic signal; and a satellite subscriber unit coupled to said traffic signal controller to provide said first information to said traffic signal controller, said satellite subscriber unit receiving said first information via said earth orbiting communication satellite.

22. A traffic control system in accordance with claim 20, wherein:

said second central control unit is operable to communicate with said second plurality of local controllers.

23. A traffic control system in accordance with claim 21, wherein:

said second central control unit is geographically remote from said second plurality of local controllers.

24. A traffic control system in accordance with claim 21, wherein:

said second central control unit is geographically remote from said at least one central control unit.

25. A traffic control system in accordance with claim 21, wherein:

said at least one central control unit is operable to communicate with said second plurality of local controllers.

26. A traffic control system in accordance with claim 20, wherein:

each said satellite subscriber unit of said second plurality of local controllers has associate therewith a telephone number and is accessible via a satellite communication system by utilizing said telephone number.

27. A traffic control system in accordance with claim 20, wherein:

each said satellite subscriber unit of said plurality of local controllers and each said satellite subscriber unit of said second plurality of local controllers has associate therewith a telephone number and is accessible via a satellite communication system by utilizing said telephone number.

28. A traffic control system in accordance with claim 16, wherein:

each said satellite subscriber unit has associate therewith a telephone number and is accessible via a satellite communication system by utilizing said telephone number.

29. The method in accordance with claim 16 wherein said earth orbiting communication satellite is a low earth orbiting satellite.

* * * * *